United States Patent [19]

Jans

[11] Patent Number: 4,997,220

[45] Date of Patent: Mar. 5, 1991

[54] DOOR LATCH DEVICE

[75] Inventor: Franz W. Jans, Roedermark, Fed. Rep. of Germany

[73] Assignee: Armaturen & Presswork, Roedermark, Fed. Rep. of Germany

[21] Appl. No.: 466,993

[22] Filed: Jan. 18, 1990

Related U.S. Application Data

[63] Continuation-in-part of Ser. No. 392,564, Aug. 11, 1989, Pat. No. 4,974,883.

[51] Int. Cl.[5] ..... E05C 1/08

[52] U.S. Cl. ..... 292/169.16; 292/359

[58] Field of Search ..... 292/169–169.21, 292/166, 150, 359

[56] References Cited

U.S. PATENT DOCUMENTS

| | | | |
|---|---|---|---|
| 2,268,973 | 1/1942 | Voight | 292/169.16 |
| 2,407,133 | 9/1946 | Cerf | 292/359 |
| 2,412,789 | 12/1946 | Voight | 292/359 |
| 2,420,083 | 5/1947 | Lickteig | 292/169.16 |
| 2,420,113 | 5/1947 | Vander Henst | 292/169.16 |
| 2,431,814 | 12/1947 | Lickteig | 292/169.16 |
| 2,486,268 | 10/1949 | Erkkila | 292/359 |
| 2,687,319 | 8/1954 | Quigley et al. | 292/169.16 |
| 3,361,462 | 1/1968 | Foster | 292/359 |

*Primary Examiner*—Eric K. Nicholson
*Attorney, Agent, or Firm*—H. Michael Brucker

[57] ABSTRACT

A latch device including a privacy lock control member reciprocatably moveable along a first predetermined path of movement, and a manually operable member for reciprocatably moving said control member in a direction generally opposed to the direction of movement of the manually operable member.

Movement is imparted to the control member by a pivoted linkage arm interconnected at opposed ends to the manually operable member and the control member.

8 Claims, 3 Drawing Sheets

DOOR LATCH DEVICE

This application is a continuation-in-part of copending U.S Pat. application Ser. No. 07/392,564, filed Aug. 11, 1989 now U.S. Pat. No. 4,974,883.

TECHNICAL FIELD

This invention relates to a latch device for doors and, more particularly, to a latch device which incorporates a mechanism enabling the operator to actuate a privacy lock feature by pushing an outwardly accessible member rather than pulling a member as would normally be dictated by the interior mechanism of the latch device. Further, the latch device incorporates structure automatically deactuating the privacy lock upon retraction of the device latch element. This latter feature prevents inadvertent application of the privacy lock.

BACKGROUND ART

Co-pending U.S. Pat. application Ser. No. 7/392,564 filed Aug. 11, 1989, relates to an improved latch device for doors. More particularly, the application discloses a latch device characterized by relative simplicity and compact size. Such latch device incorporates structure enabling it to be utilized as a passage latch actuatable from both sides of the door with which it is associated or, alternatively, as a privacy locking system which is selectively adjustable by the operator to permit handle or doorknob actuation from only one side of the door.

While the latch device just described in general terms has a number of desirable features, it incorporates an externally actuatable control member which must be pulled, rather than pushed, to utilize the privacy lock feature. Furthermore, a door in which such latch device is mounted can be closed with the privacy lock feature remaining operative, thus creating potential problems. For example, a child can close the door unaware that the privacy lock feature is operative and find himself or herself unable to deactuate the privacy lock.

DISCLOSURE OF INVENTION

The present invention relates to a latch device generally of the type disclosed in the aforesaid U.S. Pat. application Ser. No. 07, 392,564. However, the latch device of the present invention incorporates structure greatly adding to the overall convenience and ease of use thereof.

More specifically, the present latch device incorporates structure enabling the privacy lock feature to be actuated by a push, rather than pull, manual motion. Further, the latch device incorporates structure automatically deactuating the privacy locking system upon retraction of the latch device latch element, for example, by a door frame when the door is closed with the privacy lock operative.

Other features, advantatges, and objects of the present invention will become apparent with reference to the following detailed description and accompanying drawings.

BEST MODE FOR CARRYING OUT THE INVENTION

Figure 1:
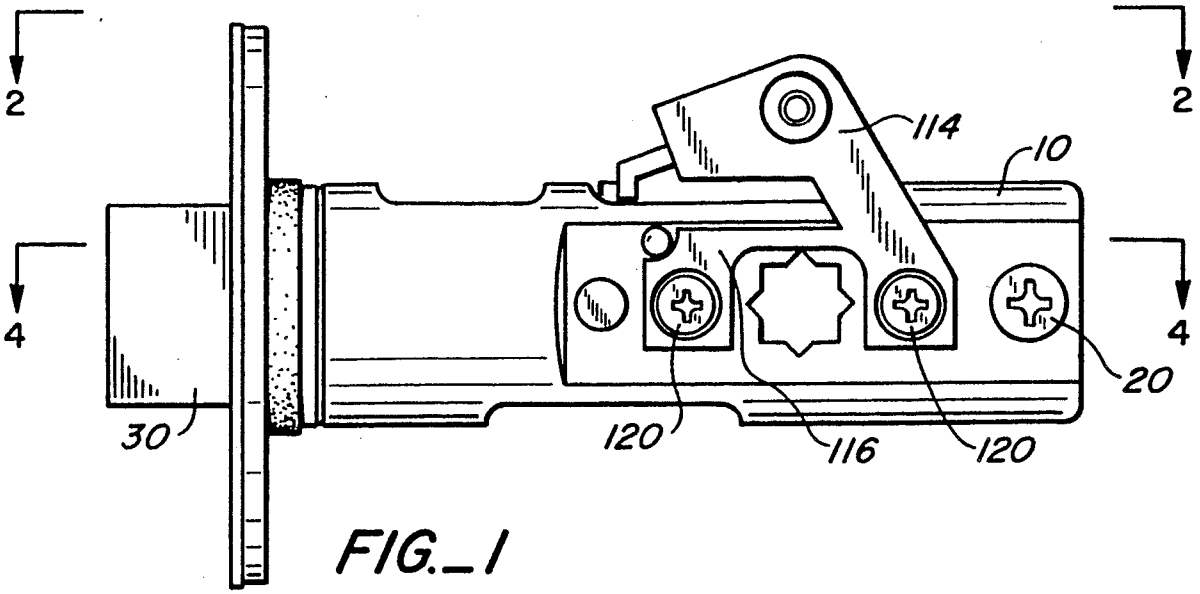
FIG. 1 is a side view of a latch device constructed in accordance with the teachings of the present invention.

Referring now to the drawings, a latch device constructed in accordance with the teachings of the present invention is illustrated and includes a housing 10 defining an interior 12. An opening 14 is disposed at one end of the housing and communicates with the housing interior.

The housing is comprised of two housing segments 16, 18 secured together by any suitable means such as a screw 20 which has threads engaging mating threads in housing segment 16. Segment 16 includes a wall 17 and segment 18 includes a wall 19 opposed thereto.

A latch element 22 is disposed in housing interior 12 and includes a latch body 24 and a latch head 26. As is conventional, the latch head includes a generally tapered surface 28 and a substantially flat abutment surface 30. The latch head is enlarged as at 32 and a circular-shaped boss 34 projects therefrom. Boss 34 is disposed within a recess 36 of generally corresponding configuration formed in latch body 24.

A coil compression spring 44 has one end thereof disposed in a recess 45 formed in the latch body 24. The other end of spring 44 engages wall member 46 and surrounds a circularshaped projection 48 integral with the wall member. As may perhaps best be seen with reference to FIG. 4, wall member 46 is prevented from moving toward the right as viewed in that figure because it is in engagement with a peripherally extending abutment surface 50 defined by the housing.

Spring 44 continuously urges the latch element 22 to the left as shown in FIGS. 1, 2, 3 and 4. The latch element is linearly reciprocatably moveable relative to housing 10 between an extended position whereat the head projects from the housing interior through opening 14 and a retracted position whereat the head is substantially completely retracted in the housing interior.

Means is operatively associated with the latch element for moving the latch element from the extended position to the retracted position. The latch element moving means includes actuator mechanisms including cam means rotatably mounted relative to the housing and adapted to be rotated by means accessible outside the housing. In particular, the cam means includes two relatively moveable cam elements 52, 54 disposed side by side within the housing. Each cam element includes a round boss 56 which projects through a corresponding hole formed in one of housing segments 16, 18 whereby the cam elements are maintained in position and yet are rotatable to a predetermined degree within the housing.

Each cam element defines a channel 58, the channels 58 being curved and accommodating therein double-ended coil compression springs 60. One end of each coil compression spring engages an indent 62 formed in the housing wall. With specific reference to FIG. 3, it will be seen that cam element 52 is continuously biased by its associated spring 60 in a counter clockwise direction as viewed in that figure. The same, of course, holds true for cam element 54. Engagement between the cam elements and the wall of the housing limits such rotation and springs 60 are always maintained under compression.

Each cam element includes a lobe 64 engageable with a transmission arm 70. More specifically, the lobes 64 are engageable with a first projection 72 of said transmission arm. The transmission arm 70 is pivotally mounted on a pin 74 which extends between support recesses formed at spaced locations in the housing wall.

Transmission arm 70 also includes a second projection 76 which engages latch body 24. Again making specific reference to FIG. 3, clockwise rotation of a cam element having its lobe 64 in engagement with the first projection 72 causes the transmission arm 70 to rotate in a counter clockwise direction. This action causes the latch element 22 to move against the compression of spring 44 and retract. 10 In FIG. 4, a portion of a shaft 80 is shown. Such shaft projects completely through the housing 10, passing through apertures 82 formed in the cam elements at the location of bosses 56. It will be appreciated that the shaft 80 has attached at the opposite ends thereof manually manipulable elements such as lever handles or doorknobs.

Shaft 80 is comprised of two relatively rotatable shaft components 83 connected together by a connector which allows the shaft components to be individually rotated by their respective associated knobs or levers. A shaft of this type, which is split into two parts capable of independent movement, is known in the prior art and will not be described in detail.

Figure 4:
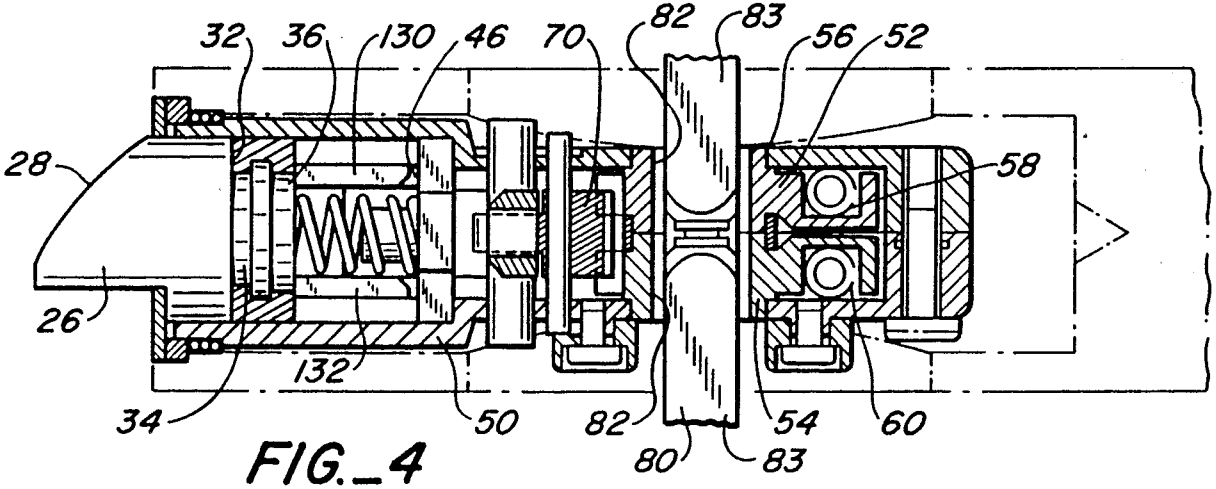
FIG. 4 is a side, sectional view taken along line 4—4 of FIG. 1 illustrating the latch device in a door.

When transmission arm 70 is in the position illustrated in FIG. 4, there is engagement between the lobes 64 of both cam elements 52, 54 and first projection 72 of the transmission arm. Thus, rotation of either of the cam elements 52, 54 by shaft components 83 will result in pivoting of the transmission arm and retraction of the latch element 22. The latch device, however, can be readily adjusted to permit latch element retraction by either of the cam elements to the exclusion of the other. In other words, the latch device has a built-in privacy locking feature. This will now be described.

Figure 3:
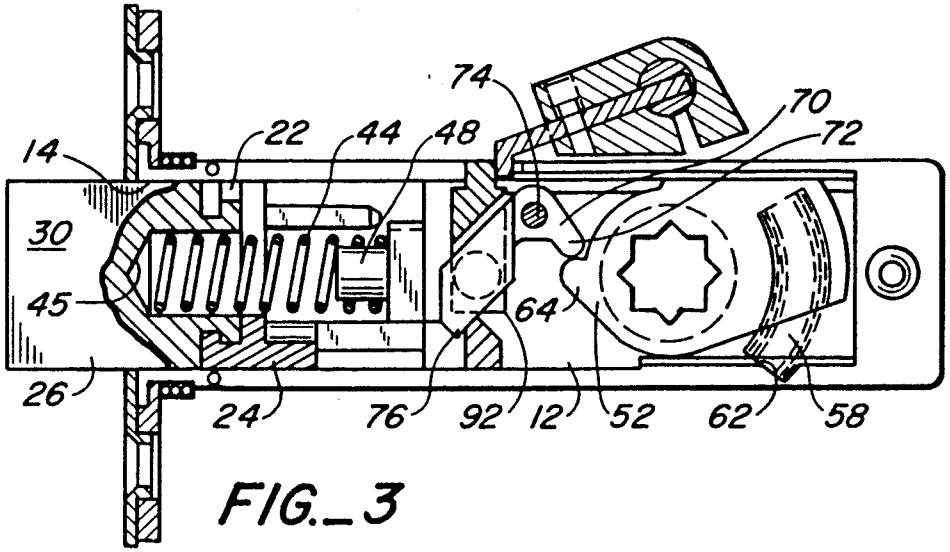
FIG. 3 is a side elevation, cross-sectional view of the latch device taken along the a line 3—3 in FIG. 1.

Disposed immediately adjacent to transmission arm 70 is a control member 84 including a control element 86 and spindles 88, 90 projecting from opposed sides of the control element. The control element 86 includes two legs 92, one of which is shown in FIG. 3. Second projection 76 of transmission arm 70 is disposed between the two legs.

It will be appreciated that lateral movement of control element 88, i.e. movement along the axis of spindles 88, 90, causes a corresponding lateral movement of the transmission arm 70. When displacement is in the direction of spindle 90, the first projection 72 of the transmission arm is in engagement with lobe 64 of cam element 54. Rotation of cam element 54 will cause retraction of the latch element 22 but rotation of cam element 52 will not.

Just the opposite condition exists when the control member and transmission arm have been displaced in the direction of spindle 88 and first projection 72 is engaged only by the lobe on cam element 52. In this latter situation, only cam element 52 is effective to cause retraction of the latch element.

The structural arrangement just described is essentially shown in the aforesaid co-pending patent application. In such arrangement, if one wishes to activate the privacy lock feature from a particular side of the housing 10 the spindle (either spindle 88 or spindle 90) must be pulled. For example, assuming that the spindles are the structural elements employed to manually actuate the privacy lock feature, spindle 88 would have had to been pulled for it to have assumed the position shown in FIG. 2. That is, someone on the side of the door corresponding to spindle 88 would have had to pull that particular spindle to prevent the latch device from being actuated by a person on the opposite side of the door, i.e. the side of the door corresponding to spindle 90.

This approach has caused difficulties for some users. First of all, in most prior art latch devices, a privacy lock is actuated by pushing in, rather than pulling out, the element which brings the privacy lock feature into operation. Also, it is, of course, much easier to push in spindles 88, 90 rather than to manually grasp them and attempt to pull them outwardly.

With the structure now to be described a latch device incorporating all of the advantages of the latch device covered by the above-identified co-pending U.S. patent application can have the privacy lock feature thereof actuated by a manually actuatable element which is pushed, rather than pulled, relative to the housing.

More particularly, the latch device constructed in accordance with the teachings of the present invention includes a manually operable member accessible from outside the housing opposed sides for moving the control member. The manually operable member is mounted on the housing for reciprocatable movement in a direction generally opposed to the direction of movement of control member 84 which, of course, includes control element 86 and spindles 88, 90. The manually operable member is in the form of a shaft 110.

Figure 2:
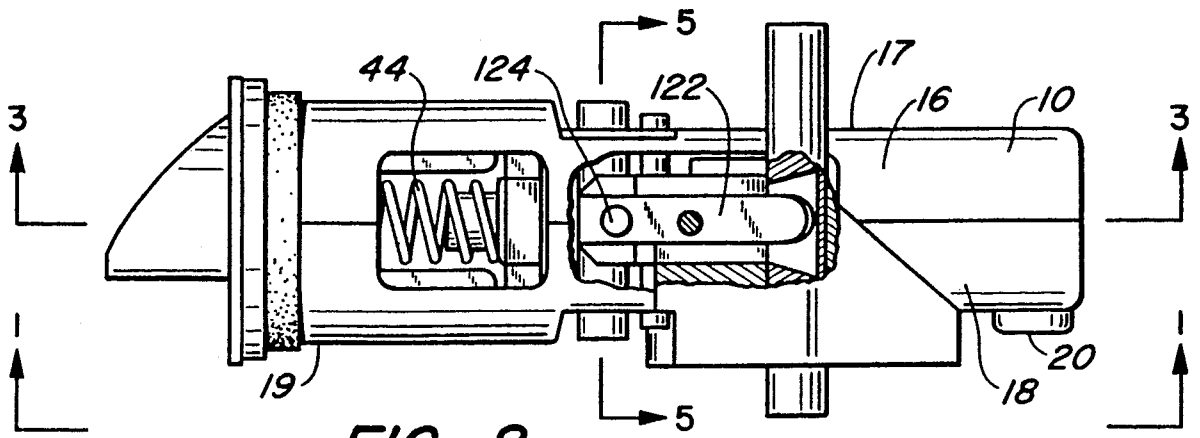
FIG. 2 is a plan view of the latch device with a portion thereof broken away.
Figure 2B:
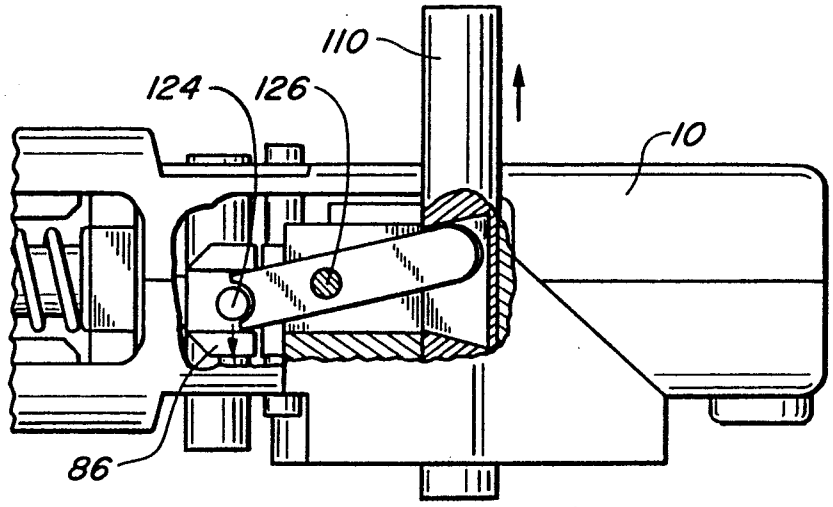
FIGS. 2A, 2B and 2C are enlarged, partial sectional, plan views illustrating selected components of the latch device in three alternate positions.
Figure 2C:
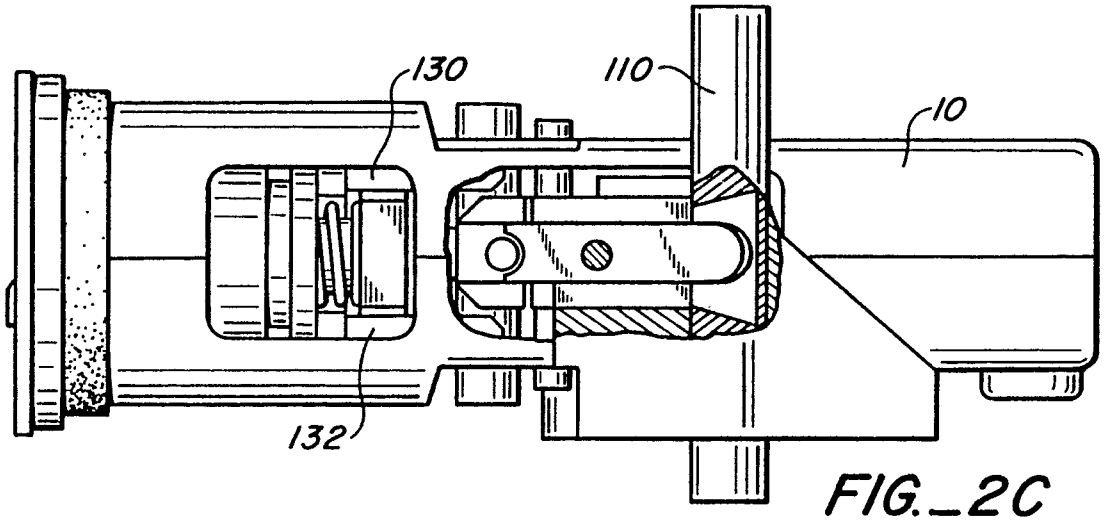
Figure 2A:
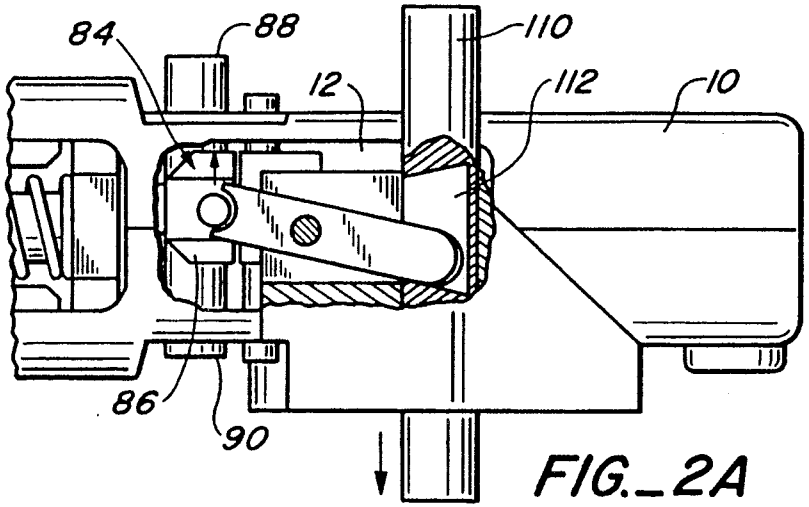
Figure 5:
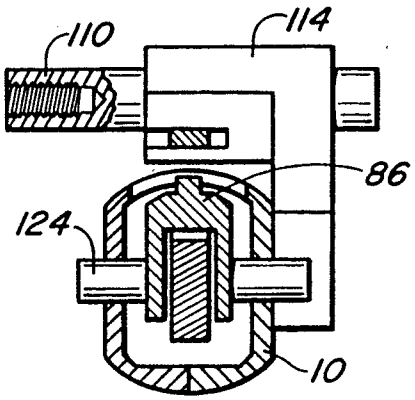
FIG. 5 is a cross-sectional view of the latch device of the present invention taken along line 5—5 of FIG. 2.

Shaft 110, as perhaps may best be seen with reference to FIGS. 2A–2C, defines a recess 112. Shaft 110 is slideably disposed in a mounting member 114 which is secured to housing 10. The mounting member 114 has a leg element 116 and the means utilized to secure the mounting member 114 to the housing 10 comprises screw-type fasteners 120 passing through apertures (not shown) in the leg element and matingly engaging screw threads formed in the housing.

A linkage arm 122 has one end thereof positioned in recess 112. That end of linkage arm 122 therefore will move with shaft 110. The other end of linkage arm 122 is connected to control element 86. In particular, a pin 124 projecting from control element 86 is disposed in an indent formed at the end of linkage arm 122 remote from shaft 110.

Linkage arm 122 is pivotally disposed on a pivot element in the form of a pin 126 affixed to housing 10. It will be appreciated that with such an arrangement axial movement of shaft 110 in a given direction will result in opposite axial movement of control member 84. FIGS. 2A and 2B show the relative positions assumed by the control member and the shaft 110 when the shaft 110 has been pushed to its two opposite extreme positions. When shaft 110 is in the position shown in FIG. 2A, control element 86 is closely adjacent to housing wall 17. When the shaft 110 has been pushed into the position shown in FIG. 2B, on the other hand, the control element 86 is closely adjacent to side 19.

With the arrangement just described, one wishing to actuate the privacy lock feature can do so merely by pushing shaft 110 in the direction of the housing, greatly adding to the convenience and usefulness of the latch device.

The latch device illustrated also has another feature that is desirable. It will be noted that spaced projections 130, 132 are attached to the latch element and project into housing 10. These spaced projections are engageable with the control element 86 when the latch element moves from its extended position to its retracted position to urge the control element to a generally intermediate position. It is to be understood that when the latch element is in said generally intermediate position, either cam element 52, 54 may be rotated from outside the associated door (shown in phantom in FIG. 4), i.e., the privacy lock feature is de-actuated.

The spaced projections have cammed surfaces at the distal ends thereof. Cammed surfaces are also formed at the sides of the control element and engageable by the cam surfaces of the projections upon movement of the latch element to its retracted position. When engagement occurs the control member moves relative to the housing to its generally intermediate position. Inadvertent closure of the door with which the latch device is associated thus will de-activate the privacy lock feature. Therefore, the privacy lock can only remain actuated when such actuation is in fact desired.

What is claimed is:

1. A latch device comprising, in combination:

a housing having opposed sides and defining an interior and an opening at one end of the housing communicating with said interior;

a latch element disposed in said housing interior and including a latch body and a latch head, said latch element movable between an extended position and a retracted position;

means operatively associated with the latch element for moving the latch element from said extended position to said retracted position, said latch element moving means including first and second actuator mechanisms selectively operatively associated with said latch element to move said latch element to said retracted position;

control means for controlling which of said actuator meachanisms is operatively associated with said latch element, said control means including a reciprocatable control member movable along a firs predetermined path of movement extending between said housing opposed sides and manually operable member accessible from outside said housing opposed sides for moving said control member, said manually operable member mounted on said housing for reciprocatable movement in a direction generally opposed to the direction of movement of said control member; and linkage means interconnecting said manually operable member and said control member for moving said control member in response to generally opposed movement of said manually operable member, said control member including a control element movable between said opposed housing sides for selective engagement by said first and second actuator mechanisms, and said linkage means being connected to said control element to move said control element between said opposed housing sides in response to movement of said manually operable member.

2. The latch device according to claim 1 wherein said linkage means includes a double-sided linkage arm having a first end thereof connected to said manually operable member and a second end thereof connected to said control element, said latch device additionally comprising a pivot element fixed relative to said housing, said linkage arm being pivotally connected to said pivot element at a location on said linkage arm between said first and second ends.

3. The latch device according to claim 1 including means operatively associated with said control member and said latch element to move said control element to a position generally intermediate said opposed housing sides responsive to movement of said latch element to said retracted position.

4. The latch device according to claim 3 wherein said means for moving said control element to a generally intermediate position comprises spaced projections attached to said latch element and projecting into said housing, said spaced projections being engageable with said control element to urge said control element to said generally intermediate position when said latch element moves from said extended position to said retracted position.

5. The latch device according to claim 4 wherein said control member additionally includes spindles projecting from opposed sides of said control element, said spindles being slidably disposed in apertures formed in said opposed housing sides, said control element and said spaced projections each defining cam surfaces, the cam surfaces of said control element being engageable by the cam surfaces of said projections upon movement of said latch element to said retracted position to move said control member relative to said housing.

6. The latch device according to claim 1 wherein said manually operable member includes a shaft, said latch device additionally comprising mounting means attached to said housing and defining a throughbore slidably accommodating said shaft.

7. The latch device according to claim 6 wherein said shaft defines a recess, said latch device additionally comprising a double-ended linkage arm interconnecting said manually operable member and said control member for moving said control member in response to movement of said manually operable member, said linkage arm having one end thereof disposed in said shaft recess whereby said one end moves with said shaft.

8. The latch device according to claim 6 wherein said mounting means includes a leg element secured to one of said opposed housing sides to affix said mounting means to said housing.

* * * * *